United States Patent [19]

Wu-Heng

[11] 4,055,164

[45] Oct. 25, 1977

[54] APPARATUS FOR AUTOMATIC GAS IGNITION CONTROL

[76] Inventor: Tu Wu-Heng, No. 33 Sec, 3, Ming-Teng Road, Jui-Fang Chen, Taipei Hsien, China /Taiwan

[21] Appl. No.: 704,109

[22] Filed: July 9, 1976

[51] Int. Cl.[2] ..... F24H 1/00

[52] U.S. Cl. ..... 126/351; 137/410; 431/46

[58] Field of Search ..... 126/351, 374; 431/43, 431/46, 79; 122/504; 137/410, 412; 251/141

[56] References Cited

U.S. PATENT DOCUMENTS

| | | | |
|---|---|---|---|
| 2,449,538 | 9/1948 | Ackerman | 122/504 |
| 2,586,257 | 2/1952 | Ray | 431/79 |
| 2,805,652 | 9/1957 | Stout | 122/504 |
| 2,989,117 | 6/1961 | Graves | 431/79 |
| 3,082,359 | 3/1963 | Mangiafico et al. | 251/141 |
| 3,109,415 | 11/1963 | Rowell | 122/504 |
| 3,359,972 | 12/1967 | Carothers | 126/351 |
| 3,614,278 | 10/1971 | Di Noto, Jr. | 126/351 |
| 3,776,200 | 12/1973 | Tine et al. | 122/504 |
| 3,834,357 | 9/1974 | Kaczmarek et al. | 122/504 |

*Primary Examiner*—John J. Camby
*Assistant Examiner*—Larry I. Schwartz

[57] ABSTRACT

This invention relates to an apparatus for automatic gas ignition control for igniting an auxiliary fire nozzle and main fire nozzle in a water heater, to precisely, safely and automatically ignite the gas. The apparatus for automatic gas ignition control according to the present invention provides an alarm to give early warning if the unit is not being fed a sufficient amount of gas. Further, this invention provides a gas flow controller to control the flow rate of gas dependent upon the change of water level or pressure requirements. Also this invention provides an electric circuit for igniting the auxiliary fire and the main fire. If any component in the electric circuits is damaged, the circuit will cease to operate or function and no gas will flow. This provides an absolute protection avoiding accidents.

8 Claims, 9 Drawing Figures

APPARATUS FOR AUTOMATIC GAS IGNITION CONTROL

BACKGROUND OF THE INVENTION

1. Field of the Invention

This invention relates to an apparatus for automatic gas ignition.

2. Brief Description of the Prior Art

This invention provides a precise, safe, low cost and convenient type of apparatus for automatic gas ignition control.

In the conventional water heater using gas fuel, it requires the user to first manually ignite an auxiliary (pilot) fire. The main gas valve is then turned open, and only then can hot water be obtained. This is a very inconvenient procedure.

Additionally, the conventional method of igniting gas fire can be very dangerous. This is especially true when the auxiliary fire goes by wind or for some other reason. Also, gas leakage takes place from time to time through the carelessness of the users. More importantly, it may cause a gas explosion if one turns open the main gas valve before ignition of the auxiliary fire.

In another respect, many components are used in the construction of conventional automatic gas ignitioned water heaters, thereby making the assembly complex and the manufacture cost, therefore, high.

BRIEF SUMMARY OF THE INVENTION

The primary aim and advantages of the present invention are to provide an apparatus for automatic gas ignition control which can precisely and safely ignite the auxiliary fire and the main fire.

Due to the fact the user need only open the main gas valve and light the auxiliary fire to obtain main fire automatically, it is quite convenient.

The apparatus for automatic gas ignition control according to the present invention provides an alarm to give early warning if the unit is not being fed a sufficient amount of gas. Further, this invention provides a gas flow controller to control the flow rate of gas dependent upon the change of water level or pressure requirements.

Also this invention provides an electric circuit for igniting the auxiliary fire and the main fire. If any component in the electric circuits is damaged, the circuit will cease to operate or function and no gas will flow. This provides an absolute protection avoiding accidents.

BRIEF DESCRIPTION OF THE DRAWINGS

Other characteristics and advantages of the invention will be apparent, not for limitation but for example, from the following description and the accompanying drawings where.

DETAILED DESCRIPTION OF THE PREFERRED EMBODIMENT

Figure 1:
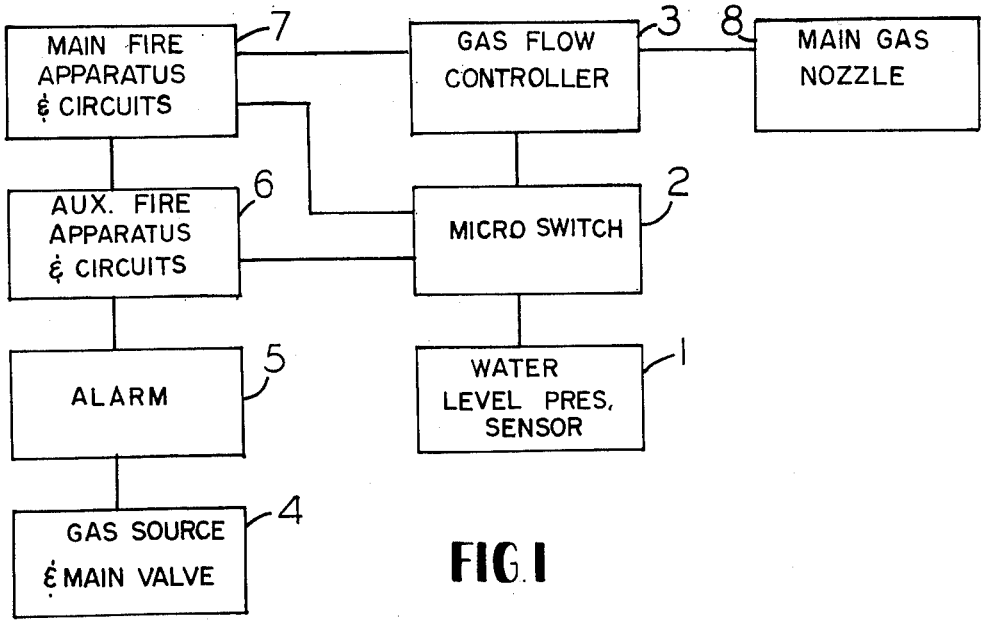
FIG. 1 is a block diagram showing the whole ignition system of the apparatus for automatic gas ignition control according to the present invention.

The function of the apparatus according to the present invention may be better understood by reference to the block diagram in FIG. 1 where a water pressure sensor referred as block 1 is to control the micro switch block 2 to be in an "on" or "off" state. Also the water level or pressure sensor 1 can directly decide the gas flow rate in the gas flow controller block 3.

An alarm block 5 operates when the gas pressure in gas source and main valve block 4 falls below a certain value.

The automatic gas ignition apparatus for the auxiliary fire, together with the high voltage electric ignition circuit in block 6, starts to function when the micro switch block 2 comes "on". The automatic gas ignition apparatus for the main fire, together with its electric ignition circuit in block 7, starts to operate when the micro switch block 2 is "on" and the auxiliary fire has ignited.

The gas jetted from the main gas nozzle in block 8 will then be ignited by the operation of gas ignition apparatus in block 7 through gas flow controller 3.

The diagramed system of FIG. 1 will complete the automatic gas ignition function successfully and safely with only opening the main gas valve, under control of the water level or pressure.

Figure 2:
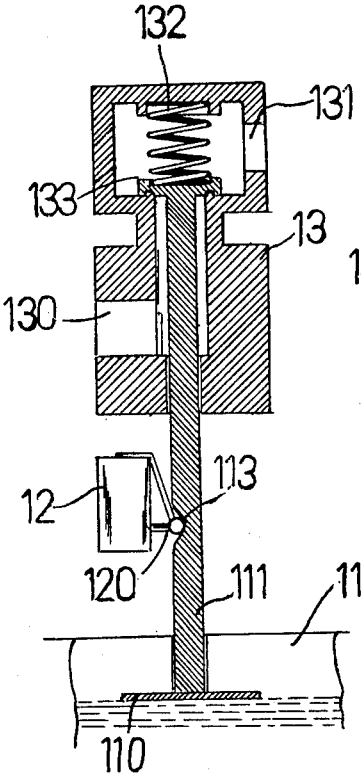
FIG. 2 is a vertical sectional view of a possible structure of water pressure sensor, micro switch, and gas flow controller according to the present invention.

FIG. 2 shows the preferred construction of apparatuses of blocks 1, 2 and 3. The water level sensor 11 is inclusive of a plate 110 to sense the water level change. A vertical rod 111 moves upward or downward due to the change in water level.

The switch button 120 of the micro switch 12 is cammed by the sloping sides of rod recess 113 to move to an "on" state.

The gas flow controller 13 is constructed having a gas entrance port 130, a gas exit port 131, a diaphragm 133 fixed on rod 111, and a tension spring 132. The extent of the upward movement of the rod 111 influenced by water level will control the gas flow rate. It is easily seen that the rod 111 will be pushed to its initial position by the tension force of the spring 132 when water level is diminished and pushed upwardly against spring 132 when water level increases. Thus, no gas flows if the water level falls below a safe limit.

Figure 3A:
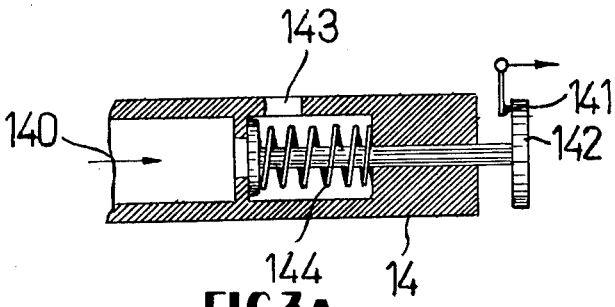
FIGS. 3*a* and *b* are vertical sectional views of a possible alarm structure according to the present invention.
Figure 3B:
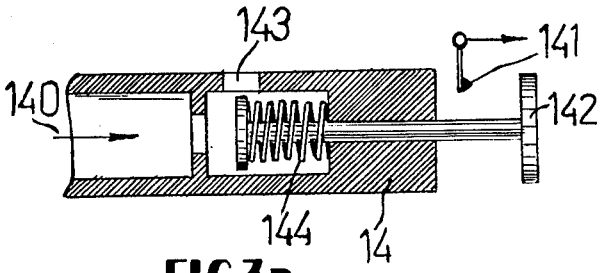

The construction of alarm is shown in FIG. 3. If the gas pressure in the gas source is too low (FIG. 3*a*) the contact plate 142 of the alarm 14 will come in contact with a limit switch 141 to complete an electric circuit to a buzzer alarm. Under normal condition, referring to FIG. 3*b*, the gas pressure is larger than the tension force of the spring 144, and gas will flow from the entrance port 140 to the exit port 143 giving a normal gas supply.

Figure 4A:
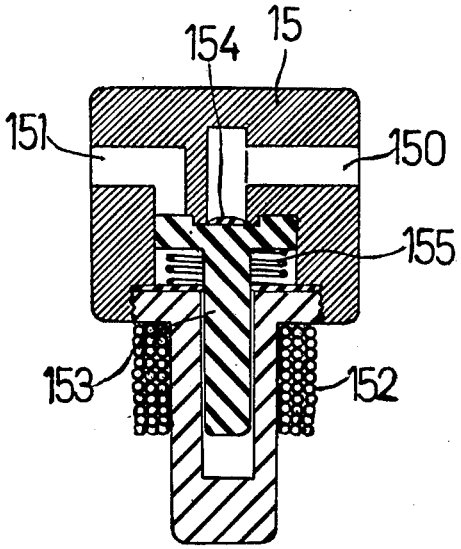
FIGS. 4*a* and *b* are vertical sectional views of the apparatus for automatic gas control both for the auxiliary fire and the main fire according to the present invention.
Figure 4B:
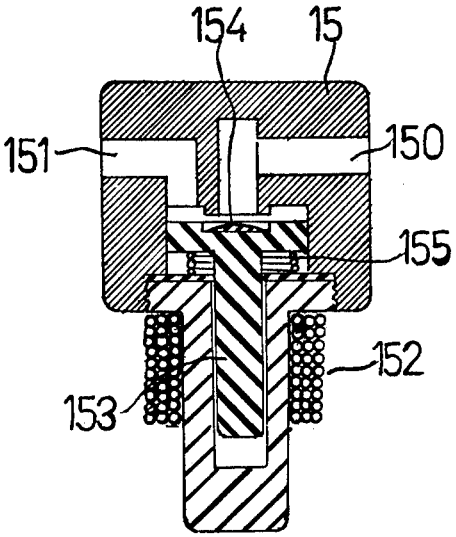

The construction of the automatic gas control apparatus both for the auxiliary fire and the main fire is shown in FIG. 4. This automatic control apparatus 15 consists of the gas entrance port 150, gas exit port 151, electromagnetic coil 152, steel bar 153, rubber diaphragm 154 and the spring 155. When the micro switch 12 in FIG. 2 is actuated to the "on" state, the electromagnetic coil 152 will then be excited to produce a magnetic flux attracting the steel bar 153 to move it downwardly. Gas can then flow from the entrance port 150 to the exit port 151 providing a normal gas supply (see FIG. 4*b*).

Figure 5:
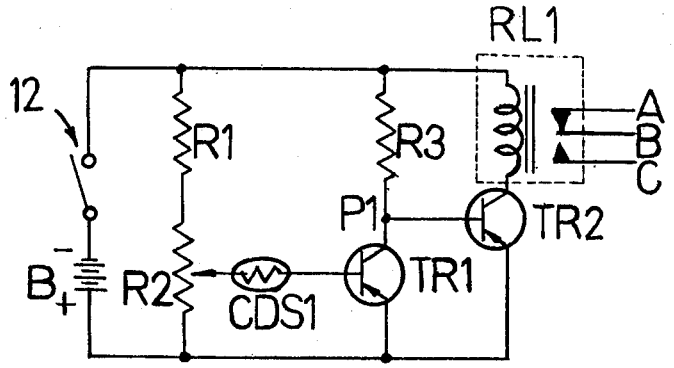
FIG. 5 is the gas ignition circuit for the auxiliary fire.
Figure 6:
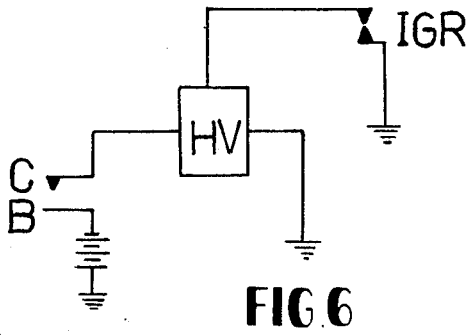
FIG. 6 is the high voltage ignition circuit for the auxiliary fire.

The high voltage electric ignition circuits for the auxiliary fire are shown in FIGS. 5 and 6. When micro switch 12 in FIG. 2 is actuated to the "on" state, the ignition circuit in FIG. 5 is tuned "on". It firstly controls an automatic gas control apparatus to supply gas for the auxiliary fire by the method stated before in connection with FIG. 4.

The relay RL1 is normally closed between its contact points A & B. At the beginning, when micro switch 12 is "off", the photoresistor CDS 1 has a high resistance because it is not illuminated. When micro switch 12 is "on", transistor TR 1 is therefore open circuited, R 2 having been adjusted for insuring TR 1 is "off" with switch 12 "on" and no light impinging on CDS 1. In this condition, transistor TR 2 is forward biased between its base P1 and its emitter which is tied to B+. Then the relay RL1 becomes energized and closes contact points B and C. Referring to FIG. 6, due to the function of a high voltage circuit HV, the ignitor IGR will thus ignite the auxiliary fire.

After ignition of the auxiliary fire, the resistance of CDS 1 will decrease because of the illumination by the auxiliary fire. Then transistor TR 1 starts to forward conduct causing transistor TR 2 to become reverse biased between its base and emitter. Since no more current flows in the relay RL 1, it will de-energize and recover to its A, B normally closed state. The high voltage ignition circuit will then cease to function, due to points B and C being opened.

Figure 7:
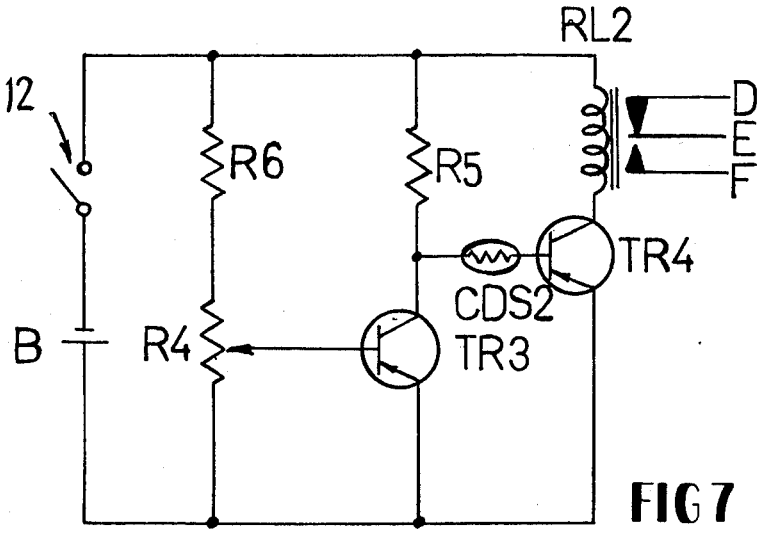
FIG. 7 is the gas ignition circuit for the main fire.

The gas ignition circuit for the main fire is shown in FIG. 7. When the micro switch 12 in FIG. 2 is "on" and before the auxiliary fire has been ignited, no current flows in the relay RL 2 with points D and E normally closed. In this state R 4 is adjusted so that transistor TR 3 is conducting, but the resistance of CDS 2 is high enough to maintain TR 4 in the "off" condition.

Once the auxiliary fire is ignited, CDS 2 is illuminated and the resistance of photoresistor CDS 2 will decrease to make transistor TR 4 become forward biased between its base and emitter. Then current flows through relay RL 2 making points E and F to be closed. This will, in turn, actuate an automatic gas control apparatus for the main fire to provide a normal main fire gas supply by the method of producing magnetic flux to attract the steel bar therein as described in connection with FIG. 4. When the main fire gas is jetted from its gas nozzle, it will preferably be ignited by the auxiliary fire immediately.

If the water pressure decreases below a predetermined level, the rod 111 in FIG. 2 will move downward and the micro switch 12 turns "off". Once the micro switch is "off", both ignition circuits for auxiliary fire and main fire will also be in the "off" state. Further, the automatic gas control apparatus for the auxiliary fire and the main fire will cease to supply gas as described.

The apparatus for automatic gas ignition control according to the present invention is very safe and convenient because: firstly, if the system is not supplied with an adequate amount of gas, the alarm will give an early warning; secondly, if any electric components in the ignition circuits are damaged or become inoperative, the circuits will cease to function and neither of the apparatus for auxiliary fire and main fire will supply gas flow; and thirdly with only the opening of the main gas nozzle and igniting of the auxiliary fire will a proper main fire be automatically obtained.

What I claim is:

1. An apparatus for automatic gas ignition control which comprises:

a. a water level sensor, micro switch, and gas flow controller for regulating the gas flow in accordance with changes in water level above a predetermined water level, said micro switch changing states when the water falls below said predetermined level;

b. an alarm mechanism including pressure measuring means, said mechanism indicating when the gas pressure upstream of said controller is below a predetermined level;

c. automatic gas control apparatus for controlling an auxiliary fire and a main fire, connected to said gas flow controller;

d. a high voltage electric ignition circuit for igniting said auxiliary fire;

e. an electric ignition circuit for igniting said main fire; and wherein said automatic gas control apparatus for producing an auxiliary fire and a main fire comprises a. a gas entrance port and a gas exit port for gas flow;

b. an electromagnetic coil to produce magnetic force;

c. a steel bar with a rubber diaphragm fixed thereon to be moved by the attraction of magnetic force produced by said electromagnetic coil, said diaphragm selectively allowing communication between said entrance port and said exit port; and d. a tension spring to restore said steel bar back to its initial position blocking said communication when said magnetic coil ceases to function;

to thereby automatically control the gas flow in accordance with an electric current in said coil.

2. An automatic gas ignition control apparatus according to claim 1, wherein said steel bar with rubber diaphragm fixed thereon is operable to control gas supply and gas cut-off by the electromagnetic energization or de-energization of said coil.

3. An automatic gas ignition control apparatus according to claim 1, wherein said high voltage electric ignition circuits for igniting an auxiliary fire comprises:

a switch, a first transistor, and a relay in circuit with a source of electric power;

a second transistor in circuit with the base of said first transistor; and a photoresistor in circuit with the base of said second transistor.

4. An automatic gas ignition control apparatus according to claim 3, further comprising at least one resistor in circuit with said transistors, whereby the function of the change of contact points in said relay is effected by the change of bias of the base of the transistors.

5. An automatic gas ignition control apparatus according to claim 3, wherein said photoresistor changes its resistance by the illumination of said auxiliary fire and thus is effective to change the state of contact points in said relay.

6. An automatic gas ignition control apparatus according to claim 1, wherein the electric ignition circuit for igniting the main fire comprises a switch, a first transistor, and a relay in circuit with a source of electric power;

a photoresistor and a second transistor in circuit with the base of said first transistor; and at least one resistor in circuit with the base of said second transistor.

7. An automatic gas ignition control apparatus according to claim 6, wherein the function of change of contact points to said relay is effected by the change of bias of the base of said first transistor.

8. An automatic gas ignition control apparatus according to claim 7, wherein the photoresistor changes its resistance by the illumination of said auxiliary fire and thus changes the bias state of the transistors and thus the state of contact points in said relay.

* * * * *